United States Patent [19]

Bowen

[11] Patent Number: 4,754,502

[45] Date of Patent: Jul. 5, 1988

[54] INFLATABLE BATH

[76] Inventor: John G. Bowen, Valley View Cottage, Newgrounds, Godshill, Fordingbridge, Hampshire, England

[21] Appl. No.: 19,193

[22] Filed: Feb. 26, 1987

Related U.S. Application Data

[63] Continuation-in-part of Ser. No. 862,146, May 12, 1986.

[51] Int. Cl.[4] ..... A47K 3/00; E04H 3/18; A61H 3/02

[52] U.S. Cl. ..... 4/487; 4/541; 4/542; 4/544; 4/493; 4/508; 128/66; 128/373

[58] Field of Search ..... 4/498, 524–525, 4/488, 487, 541–544, 508, 588; 128/66, 64, 373

[56] References Cited

U.S. PATENT DOCUMENTS

| | | | |
|---|---|---|---|
| 755,747 | 3/1904 | Coile | 4/588 |
| 3,092,101 | 6/1963 | Kinney | 4/541 X |
| 3,293,666 | 12/1966 | Casalini | 4/525 |
| 4,023,220 | 5/1977 | Younker | 4/588 |
| 41,26,905 | 11/1978 | Russell et al. | 4/492 |
| 4,137,574 | 2/1979 | Collins | 4/526 |
| 4,149,281 | 4/1979 | Bob et al. | 4/542 X |
| 4,370,543 | 1/1983 | Nemeth | 4/526 |
| 4,402,094 | 9/1983 | Sanders | 4/541 X |
| 4,420,846 | 12/1983 | Bonner | 4/541 X |
| 4,535,490 | 8/1985 | Wright | 4/488 |
| 4,546,505 | 10/1985 | Wakenshaw | 4/588 |

*Primary Examiner*—Henry K. Artis
*Attorney, Agent, or Firm*—Keith D. Beecher

[57] ABSTRACT

A self-standing inflatable bath is provided which is constructed in a manner somewhat similar to the construction of an inflatable rubber raft, and which is intended to be placed on a solid surface, such as a patio, deck, and the like; or to be floated in a swimming pool, ocean, lake, or other body of water. The bath is filled with water, or water is circulated through the bath. Pressurized steam is introduced into the bath to inflate the bath and to heat the water in the bath. The steam also serves to create bubbles in the bath water for therapeutic effects. The bath may be used as a whirlpool bath for further therapeutic effects.

3 Claims, 2 Drawing Sheets

INFLATABLE BATH

This application is a continuation-in-part of Copending application Ser. No. 862,146, filed May 12, 1986 now abandoned.

BACKGROUND OF THE INVENTION

The use of the Jacuzzi-type whirlpool bath has become popular in recent years. However, such baths have either involved relatively expensive installations for use, for example, adjacent to a swimming pool; or relatively expensive units for use in the usual domestic bathtub. Hot tubs have also become popular in recent years, but they too have usually involved relatively expensive installations.

An important objective of the present invention is to provide an inexpensive inflatable bath that can be placed on the ground, or other solid surface; or which may be placed in a swimming pool, or other body of water, and which may be operated to provide all the features of the expensive whirlpool bath or hot tub. For example, the bath may be used in the back yard in winter or summer, or it may be taken on a pleasure boat and placed in the ocean. In addition to being inexpensive, the bath of the present invention may be deflated and conveniently stored when not in use.

DETAILED DESCRIPTION OF THE ILLUSTRATED EMBODIMENT

Figure 1:
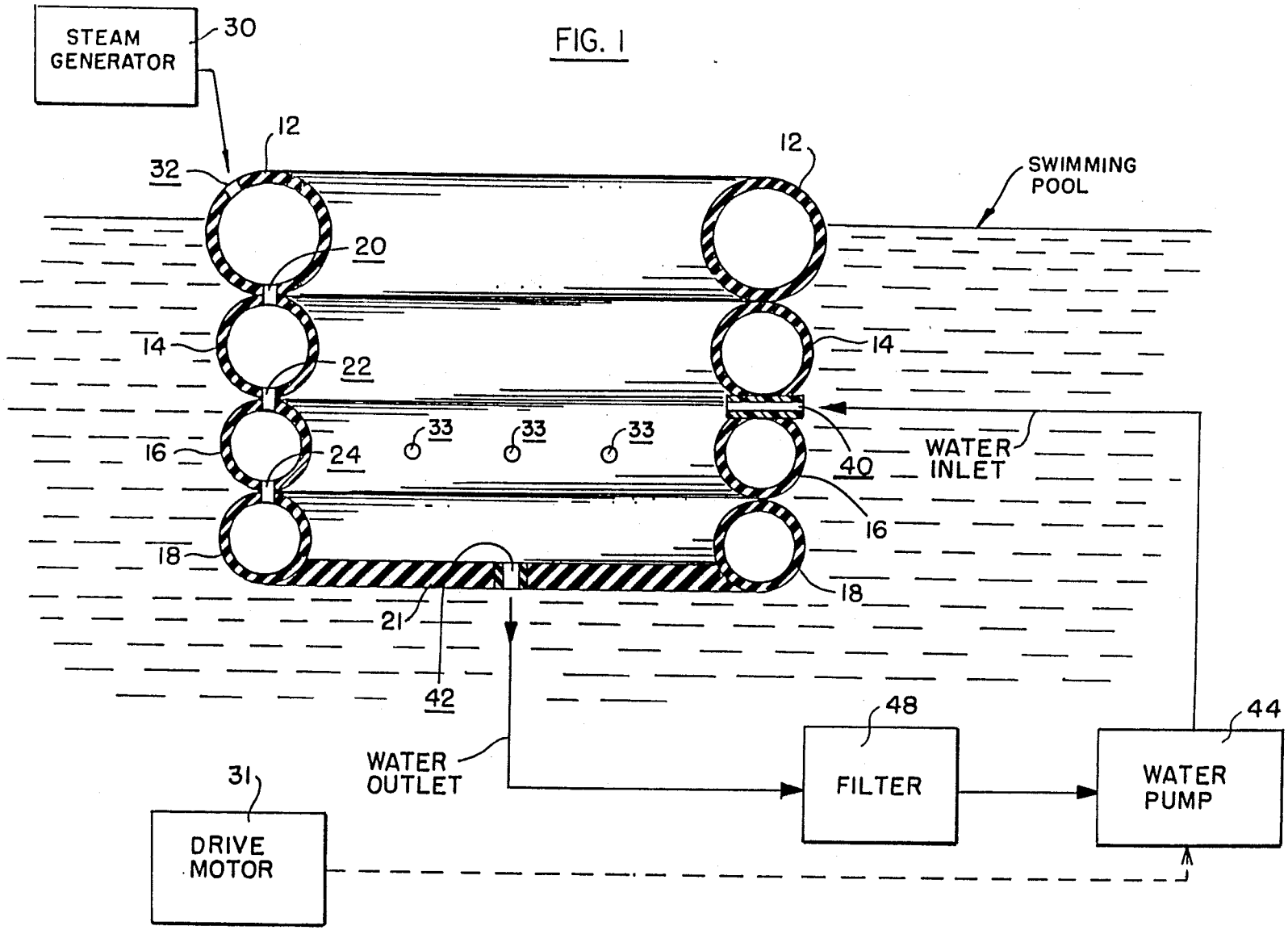
FIG. 1 is a sectional representation of a bath immersed in water, which is constructed in accordance with the concepts of one embodiment of the invention; with ancillary units for operating the bath being shown in block form.
Figure 3:
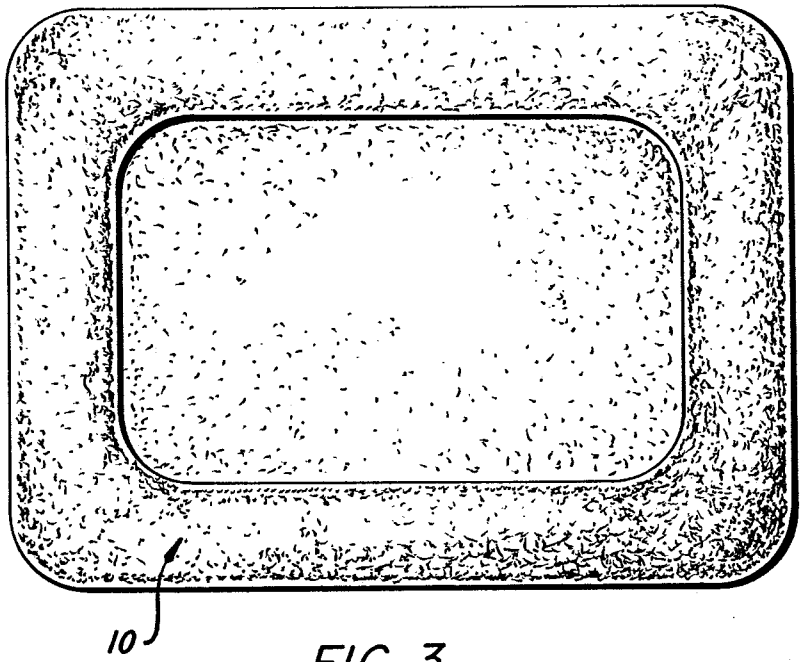
FIG. 3 is a top plan view of the bath of FIG. 2 taken along the line 3—3.
Figure 2:
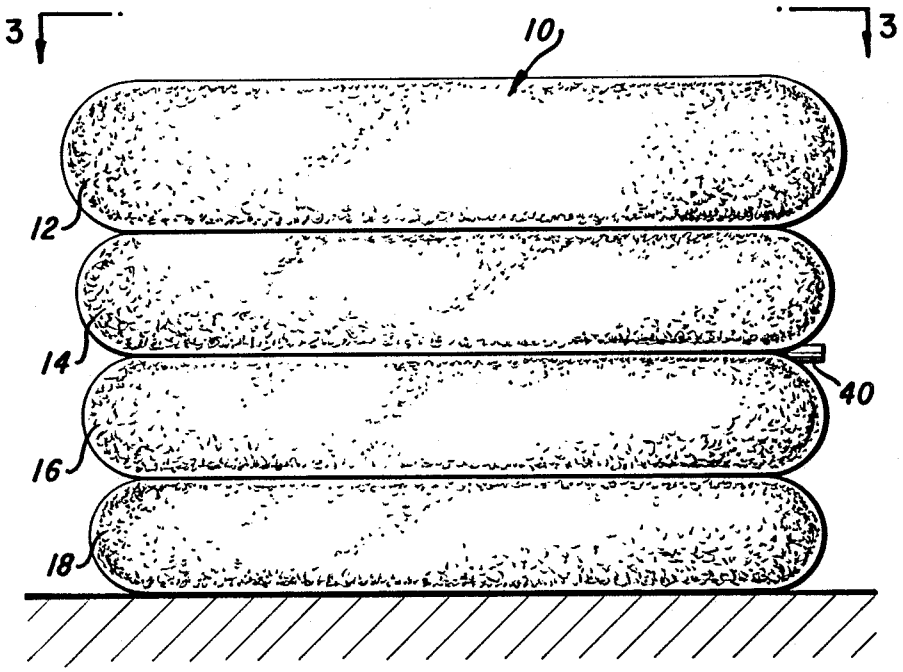
FIG. 2 is a side elevation of the bath of FIG. 1, removed from the water to illustrate its self-standing properties.

The self-standing bath 10 shown in FIGS. 1, 2 and 3 is made up of a number of tubular members 12, 14, 16, 18 which are formed of rubber, or equivalent material, and which are mounted adjacent to one another, as illustrated, and which are affixed to one another. The bath is also equipped with a bottom 20 which, likewise, may be formed of rubber, or rubber-like material, and which is affixed to the tubular member 18. The bottom 20 and the tubular members 12, 14, 16 and 18 may be of an integral construction and they form a water-tight enclosure within the bath.

As stated above, the bath 10 may be floated in water (FIG. 1), such as in a swimming pool; or it may be placed on a deck, or other supporting surface (FIG. 2). The bath is self-standing, as shown in FIG. 2, and it is preferably round, or square (FIG. 3), so that it does not require a supporting frame, or the like, when filled with water, because the force is equalized on all sides.

As illustrated in FIG. 1, the interiors of tubular members 12, 14, 16 and 18 are intercoupled with one another through vents 20, 22 and 24. Pressurized steam is obtained from a steam generator 30, and the pressurized steam is introduced through an inlet 32 into the interiors of the tubular members, in order to inflate the bath.

Steam generator 30 may be any commercially available type. Preferably, any appropriate ram steam generator is used.

When the bath is inflated, the steam is still introduced into the interiors of the tubular members by steam generator 30, and it exits from the interiors through ports 33 to heat the water in the bath and to create bubbles therein.

The bath may be filled with water by any suitable means. Alternately, water is circulated in through a water inlet 40 and out through a water outlet 42. The water is circulated, for example, by a water pump 44 which pumps the water to the water inlet 40, and which draws the water through a filter 48 from the water outlet 42. The water pump is driven at a selected speed by an electric drive motor 31 to maintain a desired level of water in the bath. The water is heated to a desired temperature by the steam introduced into the bath water through ports 33.

When the bath is used in a whirlpool bath, a number of water inlets 40 are disposed around the periphery of the bath, and the water is circulated through the bath at a relatively high rate.

Inflatable seats may be provided within the interior of the bath. Moreover, an appropriate hood may be provided for the bath, if so desired, especially when the bath is used in a cold ambient environment.

Both the steam generator 30 and water pump 44 are driven continuously when the bath is in use. Ports 33 are provided in one or more of the tubular members 12, 14, 16 and 18 so that excess steam from the interiors of these members may flow into the water in the interior of the bath to heat the water and to form bubbles therein.

The bath may conveniently be removed from the water of FIG. 1, merely by turning off the inlet water, and causing the pump 44 to empty the bath, which causes the bath to pop up to the surface of the water. The steam generator is also turned off to deflate the bath, so that it may be conveniently stored.

It will be appreciated that while a particular embodiment of the invention has been shown and described, modifications may be made. It is intended in the claims to cover the modifications which come within the true spirit and scope of the invention.

I claim:

1. In combination: a self-standing bath for use in and out of a body of water, said bath having a bottom and a side wall formed of at least one inflatable tubular member attached to said bottom to retain water in said bath, a steam generator coupled to the interior of said tubular member for introducing pressurized steam into the interior of said tubular member to inflate said tubular member, said tubular member having at least one port therein for introducing pressurized steam from the interior thereof into water contained in said bath to heat the water and to create bubbles therein and means for introducing water into the bath to a selected water level for providing an equalizing force to side wall.

2. The combination defined in claim 1, in which said bath has at least one water inlet and a water outlet; and which includes means coupled to the water inlet and to the water outlet for circulating water through the bath to maintain a particular water level within the bath.

3. The combination defined in claim 2, in which said last-mentioned means includes a pump.

* * * * *